US008131004B2

(12) United States Patent
Horigome et al.

(10) Patent No.: US 8,131,004 B2
(45) Date of Patent: Mar. 6, 2012

(54) SPEAKER APPARATUS

(75) Inventors: Minoru Horigome, Tendo (JP); Teruaki Kaiya, Tendo (JP); Yuichi Takahashi, Tendo (JP)

(73) Assignees: Pioneer Corporation, Tokyo (JP); Tohoku Pioneer Corporation, Yamagata (JP)

( * ) Notice: Subject to any disclaimer, the term of this patent is extended or adjusted under 35 U.S.C. 154(b) by 1085 days.

(21) Appl. No.: 11/600,121

(22) Filed: Nov. 16, 2006

(65) Prior Publication Data

US 2007/0121993 A1 May 31, 2007

(30) Foreign Application Priority Data

Nov. 17, 2005 (JP) ..... P2005-333339

(51) Int. Cl.
*H04R 1/00* (2006.01)
*H04R 9/06* (2006.01)
*H04R 11/02* (2006.01)

(52) U.S. Cl. ..... 381/409; 381/396; 381/400; 381/433

(58) Field of Classification Search ..... 381/409, 381/396, 400, 433
See application file for complete search history.

(56) References Cited

U.S. PATENT DOCUMENTS 1,960,016 A * 5/1934 Knauf, Jr. ..... 381/409
(Continued)

FOREIGN PATENT DOCUMENTS

JP 51-19822 2/1976
(Continued)

OTHER PUBLICATIONS

Japanese Office Action issued on Nov. 2, 2010 in the corresponding Japanese Patent Application No. 2005-333339.

*Primary Examiner* — Davetta W Goins
*Assistant Examiner* — Matthew Eason
(74) *Attorney, Agent, or Firm* — Sughrue Mion, PLLC

(57) ABSTRACT

According to an aspect of the invention, there is provided a speaker apparatus including: a speaker frame; and a connection terminal for electrically connecting to an outside of a speaker, an axis line of the connection terminal being arranged along a tangential line direction of a circumference of the speaker, the connection terminal being not projected to an outer side in a diameter direction of the speaker from the speaker frame.

17 Claims, 7 Drawing Sheets

U.S. PATENT DOCUMENTS

2003/0068065 A1* 4/2003 Klein et al. ..... 381/409

FOREIGN PATENT DOCUMENTS

JP 58-65767 U 5/1983
JP 2-13398 U 1/1990
JP 02-228198 A 9/1990
JP 10-341497 A 12/1998
JP 2005-191746 A 7/2005
JP 2005-260775 A 9/2005
JP 2005-303712 A 10/2005

* cited by examiner

SPEAKER APPARATUS

CROSS-REFERENCE TO RELATED APPLICATIONS

This application is based on and claims the benefit of priority from the prior Japanese Patent Application No. 2005-333339, filed on Nov. 17, 2005; the entire contents of which are incorporated herein by reference.

BACKGROUND

1. Technical Field

The present invention relates to a speaker apparatus.

2. Related Art

FIG. 1 shows a constitution of a general dynamic related-art speaker apparatus.

The speaker apparatus 1 includes; a magnetic circuit 3, a frame 5 attached with the magnetic circuit 3 at a rear portion thereof, a vibrating plate 9 of a cone-like shape in which an edge 7 in a roll-like shape at an outer periphery thereof is fixed to a vibrating plate supporting portion 5*a* of a front portion of the frame 5, and a voice coil 12 wound around a voice coil bobbin 11 in a cylindrical shape.

The magnetic circuit 3 includes a yoke 15 having a structure of projecting a center pole 15*b* in a cylindrical shape at a center of a plate 15*a* in a shape of a circular plate, a magnet 16 in a ring-like shape fitted to an outer periphery of the center pole 15*b*, and a top plate 17 in a ring-like shape fitted to be mounted to a front end side of the center pole 15*b* to interpose the magnet 16 between the top plate 17 and the plate 15*a*.

A gap between an inner periphery of the top plate 17 and the center pole 15*b* serves as a magnetic gap 19 for arranging the voice coil 12.

The vibrating plate 9 is formed with an opening portion 9*a* for inserting the voice coil bobbin 11 at a center thereof. The edge 7 bonded to an outer peripheral edge of the vibrating plate 9 is fixed to the vibrating plate supporting portion 5*a*. An attaching flange 7*a* mounted to an outer periphery of the edge 7 is interposed between a gasket 21 in a ring-like shape pasted to the vibrating plate supporting portion 5*a* and the vibrating plate supporting portion 5*a*.

Further, an inner peripheral portion 9*b* of the vibrating plate 9 forming the opening portion 9*a* is fixed to an outer periphery of the voice coil bobbin 11 inserted to the opening portion 9*a* by adhering or the like.

Further, a center portion of the vibrating plate 9 is pasted with a dust cap 28. The dust cap 28 covers a front side of the voice coil bobbin 11 to prevent dust and dirt from invading the magnetic gap 19.

The voice coil bobbin 11 in the cylindrical shape is fitted to an outer periphery of the center pole 15*b* movably in an axial direction and is elastically supported by the frame 5 via a damper 25 to restrict movement thereof in the axial direction.

Normally, the damper 25 forms a bellows structure concentrically with the voice coil bobbin 11.

The damper 25 damps the vibrating plate 9 by restricting displacement of the voice coil bobbin 11 in a radius direction by fixing an outer peripheral edge thereof to a damper supporting portion 5*b* of the frame 5 and fixing an inner peripheral portion thereof to an outer periphery of the voice coil bobbin 11 and absorbing vibration energy by deforming the bellows in driving the vibrating plate 9.

The frame 5 includes a plurality of frame openings 5*c* formed at predetermined intervals along a circumferential direction of the speaker between the vibrating plate supporting portion 5*a* and the damper supporting portion 5*b*. The frame opening 5*c* serves as a vent hole for escaping an air flow produced by a back pressure in driving the vibrating plate 9.

Further, the frame opening 5*c* not only serves as the above-described vent hole but also makes the frame light-weighted The related-art speaker apparatus 1 vibrates the vibrating plate 9 by a reciprocating vibration of the voice coil bobbin 11 when a voice signal is inputted to the voice coil 12 by 2 pieces of positive and negative connection cables 8, 8 from an amplifier and a pair of input terminals 4, 4 for connecting the connection cables, tinsel wires, not illustrated, whereby sound is reproduced.

According to the connection terminals 4, 4, front ends of the connection cables 8, 8 are inserted into connection openings penetrated by pushing front ends thereof in an arrow mark direction and the front ends are released from being pressed to thereby finish connection.

Meanwhile, in connecting the connection cables 8, 8 to the speaker apparatus 1, the illustrated push type connection-terminals 4, 4 are preferred since a connecting tool or other part is not needed, an allowable range of a thickness of the connection cables 8, 8 is wide, and the connection terminals 4, 4 are excellent (refer to, for example, JP-UM-A-58-65767).

Meanwhile, recently, there is increased an example for using a speaker apparatus having a large aperture of a sub woofer or the like for reproducing heavy low sound also in a vehicle-mounted audio system.

When the related-art speaker apparatus having a large aperture is designed for vehicle-mounted use, a depth dimension of a portion utilized as a cabinet of the speaker apparatus such as a vehicle-mounted speaker cabinet or an inner side of a vehicle door is limited and therefore, it is a problem to thin the speaker apparatus.

However, according to the related-art speaker apparatus 1 in which the voice coil bobbin 11 is elastically supported by the damper 25 as described above, a space of arranging the damper 25 needs to provide between the vibrating plate 9 and the magnetic circuit 3. So, it is difficult to shorten a dimension in the axial direction of the speaker apparatus in order to provide the space of installing the damper 25. Therefore, it is difficult to thin thinning the speaker apparatus.

Further, a stiffness of the damper 25 is normally larger than that of the edge 7 and therefore, mechanical fatigue by a long period of time of use is brought about earlier than in the edge 7 and there is a concern of causing a failure by deteriorating a control function.

Further, particular vibration or abrazing sound is generated by deforming the bellows in propagating vibration between the contiguous bellows on the damper The particular vibration and abrazing sound conversely effect an influence on the vibration of the voice coil 12 or the vibrating plate 9 to deteriorate sound quality. Proposals are made for the problems (refer to, for example, JP-A-2005-191746).

SUMMARY

When the above-described connection terminals capable of dealing with comparatively bold connection cables are adopted and the connection cables 8, 8 which are bold and difficult to bend are used, a comparatively large wiring space is needed. However, there is not an allowance in a depth dimension of an inner side of a speaker cabinet or an inner side of a vehicle door for attaching a thinned speaker apparatus. A space of a back face of the attached speaker apparatus is narrowed and it is difficult to ensure a space of leading out the connection cables 8, 8.

An operation of the connection cable may be extremely simple and firm by, for example, inserting the front end portion of the cord into the opening by pressing one end of the connection terminal to release the front end portion from being pressed. However, by thus configuration, this type connection cable is generally large in its size. Therefore, it is difficult to be applied to a thinned type speaker apparatus.

The present invention has been made in view of the above circumstances and provides a speaker apparatus. According to an aspect of the invention, the connection terminal and the connection cable may not be protruded from the speaker frame, even though the comparatively bold connection cable is used in the comparative connection terminal.

According to another aspect of the invention, there is provided a speaker apparatus including: a speaker frame; and a connection terminal for electrically connecting to an outside of a speaker, an axis line of the connection terminal being arranged along a tangential line direction of a circumference of the speaker, the connection terminal being not projected to an outer side in a diameter direction of the speaker from the speaker frame.

DESCRIPTION OF THE EMBODIMENTS

Figure 1:
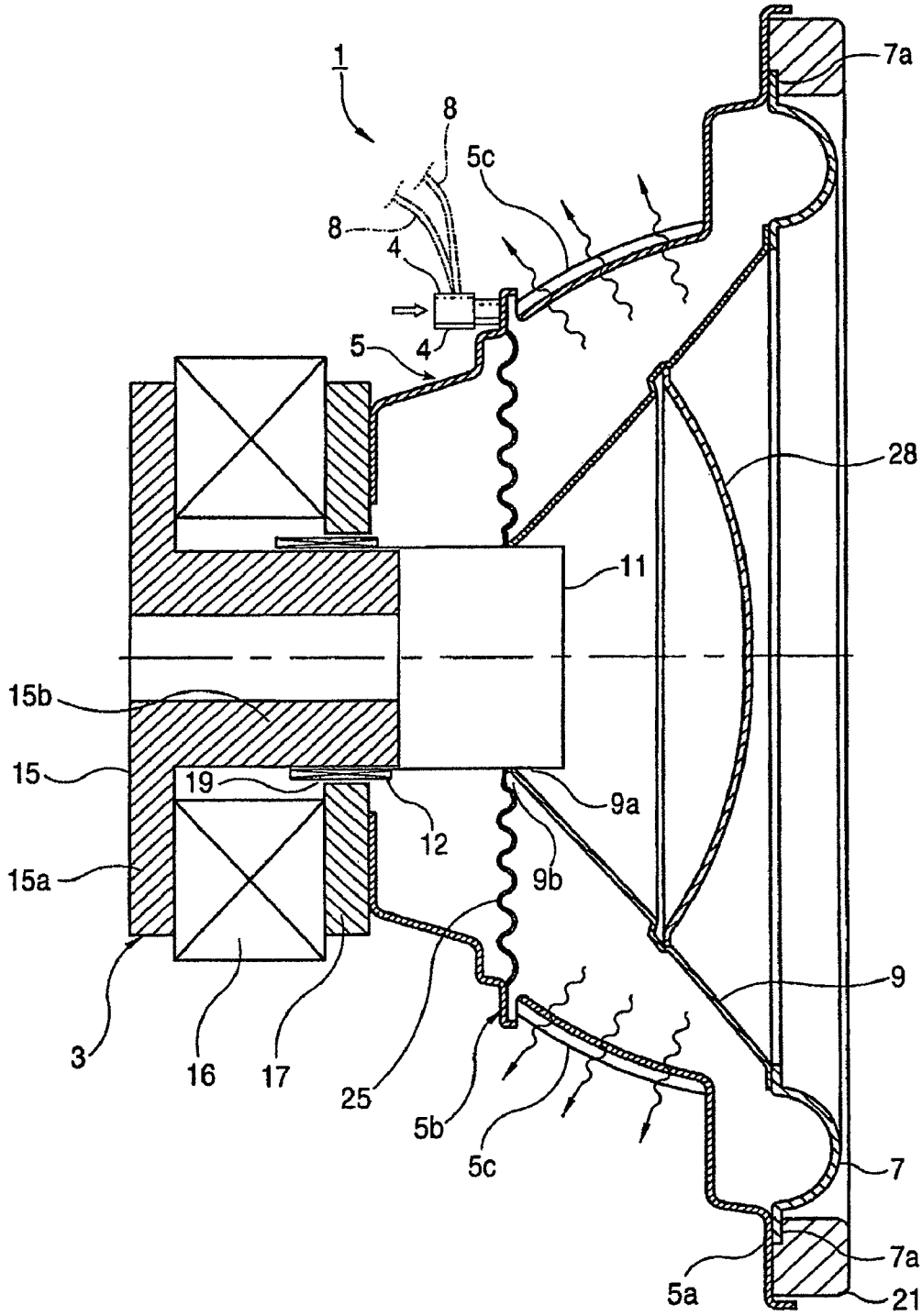
FIG. 1 (PRIOR ART)
FIG. 1 is a vertical sectional view showing a structure of a related art speaker apparatus.
Figure 2:
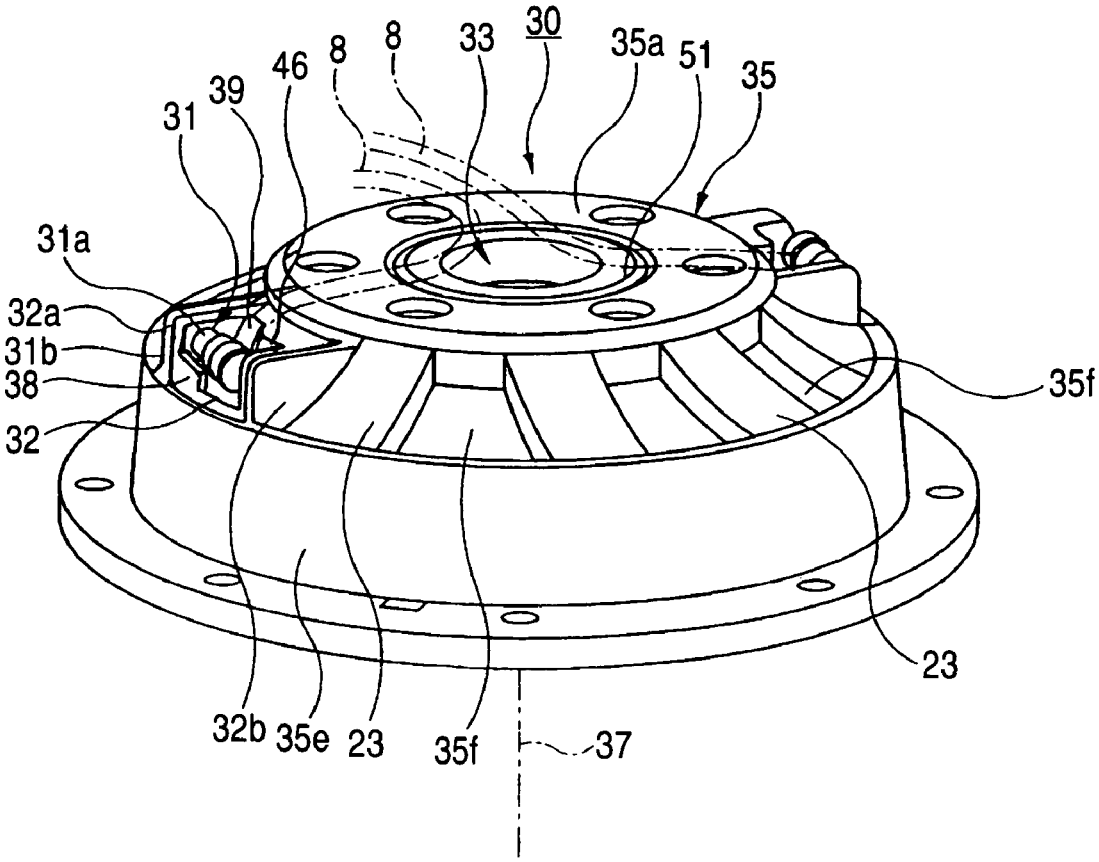
FIG. 2 is a perspective view of a speaker apparatus according to a first embodiment of the invention.
Figure 3:
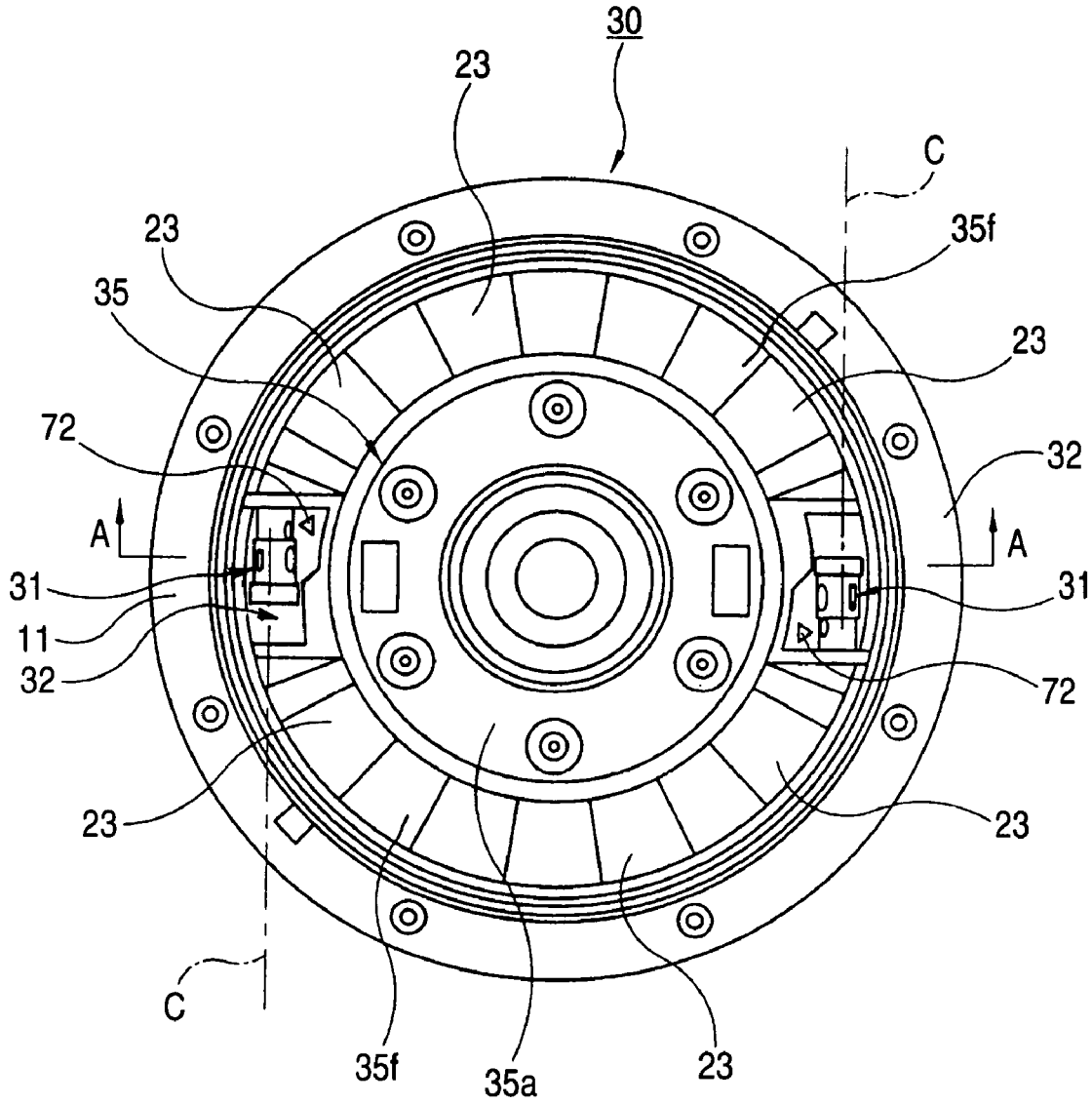
FIG. 3 is a plane view of the speaker apparatus of according to the first embodiment.

Embodiments will be explained in details with reference to the drawings as follows.

First Embodiment

As shown by FIG. 2, FIG. 3, FIG. 4 and FIG. 5, a speaker apparatus 30 according to a first embodiment of the invention has a substantially concentric shape centering on a speaker center line-37. The speaker apparatus 30 includes: a magnetic circuit 33; a speaker frame 35 attached with the magnetic circuit 33 at a rear portion thereof; a vibrating plate 41 and a drive member 42 (hereinafter, referred to as drive cone) coaxially arranged in a direction of driving the speaker, and a voice coil 46 wound around a voice coil bobbin 45 in a cylindrical shape.

The magnetic circuit 33 includes a yoke 51 having a structure of projecting a center pole 51*b* in a cylindrical shape at a center of a plate 51*a* in a shape of a circular plate, a magnet 53 in a ring-like shape fitted to an outer periphery of the center pole 51*b*, and a top plate 55 in a ring-like shape fitted to a front end side of the center pole 51*b* to interpose the magnet 53 between the top plate 55 and the plate 51*a*. A gap between an inner periphery of the top plate 55 and the center pole 51*b* forms a magnetic gap 57 of arranging the voice coil 46.

The speaker frame 35 has a shape of a bowl having a shallow bottom and an inner face of a bottom plate portion 35*a* is pertinently attached with the magnetic circuit 33 in a state of mounting the plate 51*a* of the yoke 51. The speaker frame 35 is separately provided with a positive terminal 31 (hereinafter, referred to as "an anode connection terminal 31") and a negative terminal 31 (hereinafter, referred to as "cathode connection terminal 31") which are positioned so as to interpose the magnetic circuit 33 therebetween. The magnetic circuit 33 and the connection terminals 31, 31 are thinned type which is arranged to substantially align in a speaker plane direction.

According to the first embodiment, the connection terminals 31, 31 electrically connected to outside of the speaker of, for example, an amplifier or the like are constituted such that axis lines C thereof are arranged along tangential line directions of a circumference of the speaker and are not projected to an outer side in a diameter direction of the speaker from the speaker frame 35.

Even when the speaker apparatus 30 is thinned, that is, even when the speaker frame 35 is flat, the speaker apparatus 30 can be thinner without projecting the connection terminals 31, 31 to a back face side of the speaker.

When the axis lines C of the connection terminals 31, 31 are arranged in a circumferential direction (horizontal direction) of the speaker, a diameter of the connection terminals 31, 31 can be bold and its length can be long, so that the connection terminals 31, 31 can be large-sized. Bold wires can be used for the connection cables 8, 8. an acoustic function can be maintained.

According to the first embodiment, the connection terminals 31, 31 are configured by arranging the cathode and the anode substantially on opposite sides by interposing a center of the speaker. The arrangement of the connection terminals 31, 31 is not concentrated on one portion but dispersed to two portions to facilitate to constitute the connection terminals 31, 31 by a large size.

As for an outer diameter dimension of the connection terminals 31, 31, the connection terminals 31, 31 having, for example, a skin film outer diameter of 6 mm (about 4 mm of an outer diameter without a skin) may be used.

According to the first embodiment, the connection terminals 31, 31 provided at recess portions 32 of the speaker frame 35 so as not to project from the speaker frame 35 to the side of back face of the speaker.

The speaker frame 35 is respectively provided with a vibrating plate supporting portion 35*c* of the vibrating plate 41 and a vibrating plate supporting portion 35*d* of the drive cone 42 which are apart from each other along the direction of driving the speaker.

A peripheral wall 35*b* between the two vibrating plate supporting portions 35*c*, 35*d* is constituted by a hermetically closed wall in which openings are not provided. The vibrating plate supporting portions 35*c*, 35*d* and the bottom plate portion 35*a* for holding the magnetic circuit 33 are pertinently connected by a connecting portion 23. The connecting portion 23 is constituted to form a plurality of openings 35*f* at predetermined intervals along a circumferential direction of the speaker. A back face of the vibrating plate supporting portion 35*c* of the speaker frame 35 serves as a flange face hermetically fixed to a baffle 71 of a speaker cabinet.

The vibrating plate 41 and the drive cone 42 are a cone-type vibrating plates, edges 61, 62 constituting outer peripheral portions thereof are fixed to the vibrating plate supporting portions 35*c*, 35*d* on the speaker frame 35, and inner peripheral portions 41*b*, 42*b* thereof are bonded to be fixed to the voice coil bobbin 45.

A member of a material having high internal loss for the edges 61, 62 may be used in order to attenuate vibration propagated from cone paper constituting a main body of the vibrating plate. Therefore, the edges 61, 62 may be constituted by bonding, for example, members of a material different from that of cone paper (material having-inner loss higher than that of cone paper).

According to the vibrating plate 41 arranged on a front face side of the speaker apparatus 30, a diameter of an opening of a center portion thereof is set to be larger than a diameter of an opening of the drive cone 42 arranged on the front face side of the speaker apparatus 30, and the edge 61 is provided with a bulged portion 61*a* bulged to an outer side of a hermetically closed space 67 between the vibrating plates (front face side of the speaker apparatus).

Figure 5:
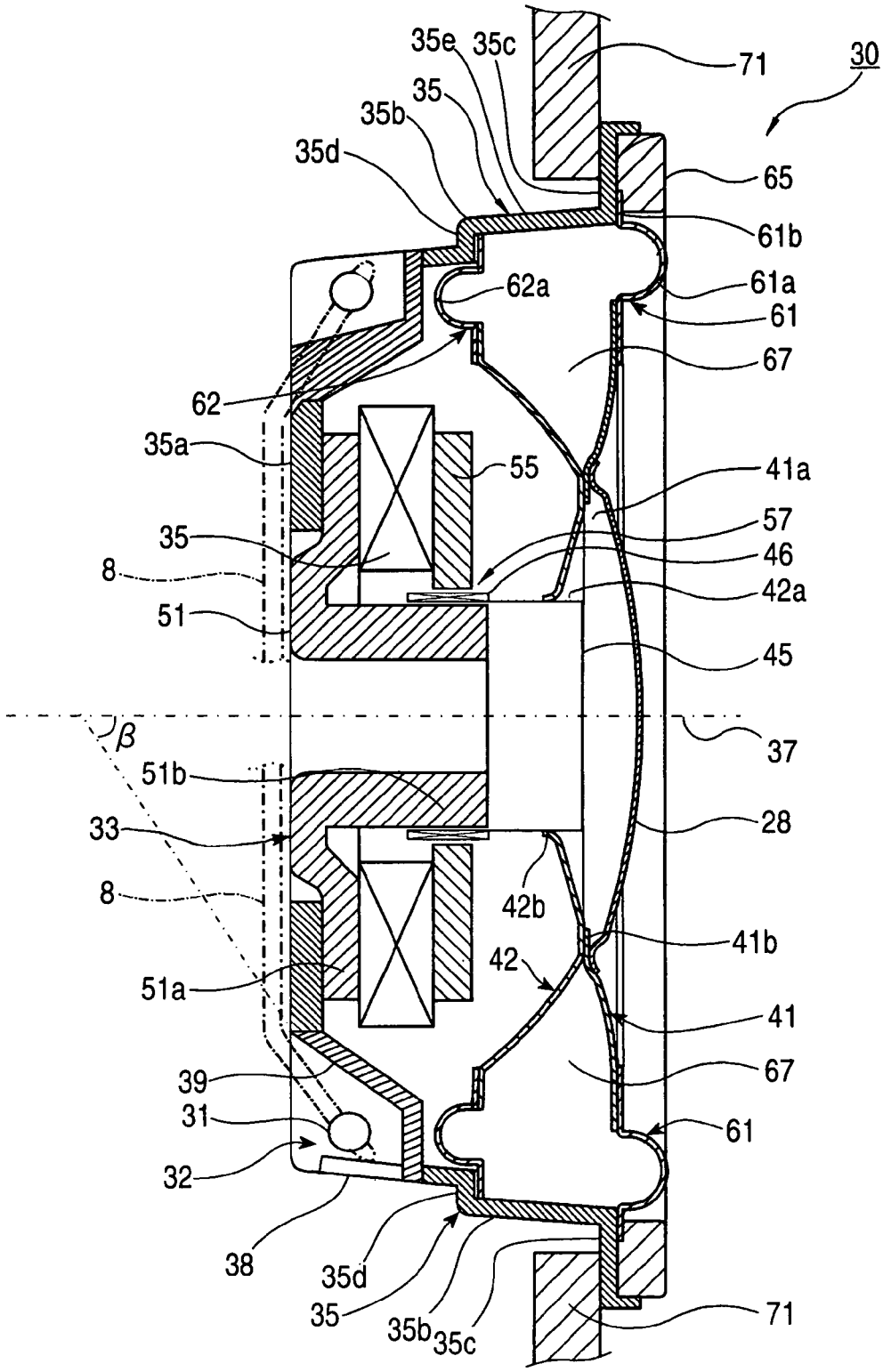
FIG. 5 is a vertical sectional view taken along a line A-A of FIG. 3.

Further, according to the drive cone 42 arranged at a back portion of the vibrating plate 41, the diameter of the opening of the center portion is set to be substantially equal to an outer diameter of the voice coil bobbin 45, and the edge 62 is provided with a bulged portion 62*a* bulged to an outer side of the hermetically closed space 67 between the vibrating plates (back face side of the speaker apparatus). Further, directions of recesses and projections of the bulged portion 61*a* and the bulged portion 62*a* are not limited to directions as shown by FIG. 5.

The respective edges 61, 62 of the vibrating plate 41 and the drive cone 42 are respectively fixed to the two vibrating plate supporting portions 35*c*, 35*d* of the speaker frame 35 mentioned above.

Further, according to the edge 61 of the vibrating plate 41, an attaching flange portion 61*b* continuously provided to an outer peripheral portion thereof is pinched by a gasket 65 and the vibrating plate supporting portion 35*c* to be fixed to the vibrating plate supporting portion 35*c*.

Further, the inner peripheral portion 41*b* of the vibrating plate 41 is bonded to the drive cone 42 in a state of being overlapped on the drive cone 42 disposed on a back side thereof.

Further, a dust cap 28 is pasted to be mounted to a center portion of the vibrating plate 41. The dust cap 28 covers a front side of the voice coil bobbin 45 to prevent dust and dirt or the like from invading the magnetic gap 57.

Further, there is constituted a structure of bonding the inner peripheral portions 41*b*, 42*b* of the vibrating plate 41 and the drive cone 42 to be fixed to the voice coil bobbin 45 by adhering to fix the inner peripheral portion 42*b* of the drive cone 42 to an outer periphery of the voice coil bobbin 45 by a pertinent adhesive.

The voice coil bobbin 45 in the cylindrical shape is fitted to an outer periphery of the center pole 51*b* movably in an axial direction and is positioned in a radius direction and in the axial direction by the drive cone 42 bonded to an outer periphery thereof.

In the case of the embodiment, the space 67 between the vibrating plates surrounded by the vibrating plate 41 and the drive cone 42 and the speaker frame 35 is hermetically closed.

When the vibrating plate 41 and the drive cone 42 are driven by displacing the voice coil bobbin 45 in the axial direction, as shown by FIG. 5, a gas of air or the like sealed in the hermetically closed space 67 between the vibrating plates is compressed by displacing the vibrating plate 41 and the drive cone 42 and displacing the edges 61*a*, 62*a* to achieve spring performance as an air spring, and the voice coil bobbin 45 is controllably supported.

According to the first embodiment, a damper for elastically supporting the voice coil bobbin 45 is not mounted on the back side of the vibrating plate 41 and the drive cone 42, and a thinned one of the speaker apparatus 30 used in a vehicle-mounted audio system or the like can be realized by shortening a dimension in the axial direction of the speaker apparatus by omitting a damper and a space of installing the damper.

The above-described connection terminals 31, 31 will be explained in details.

Figure 4:
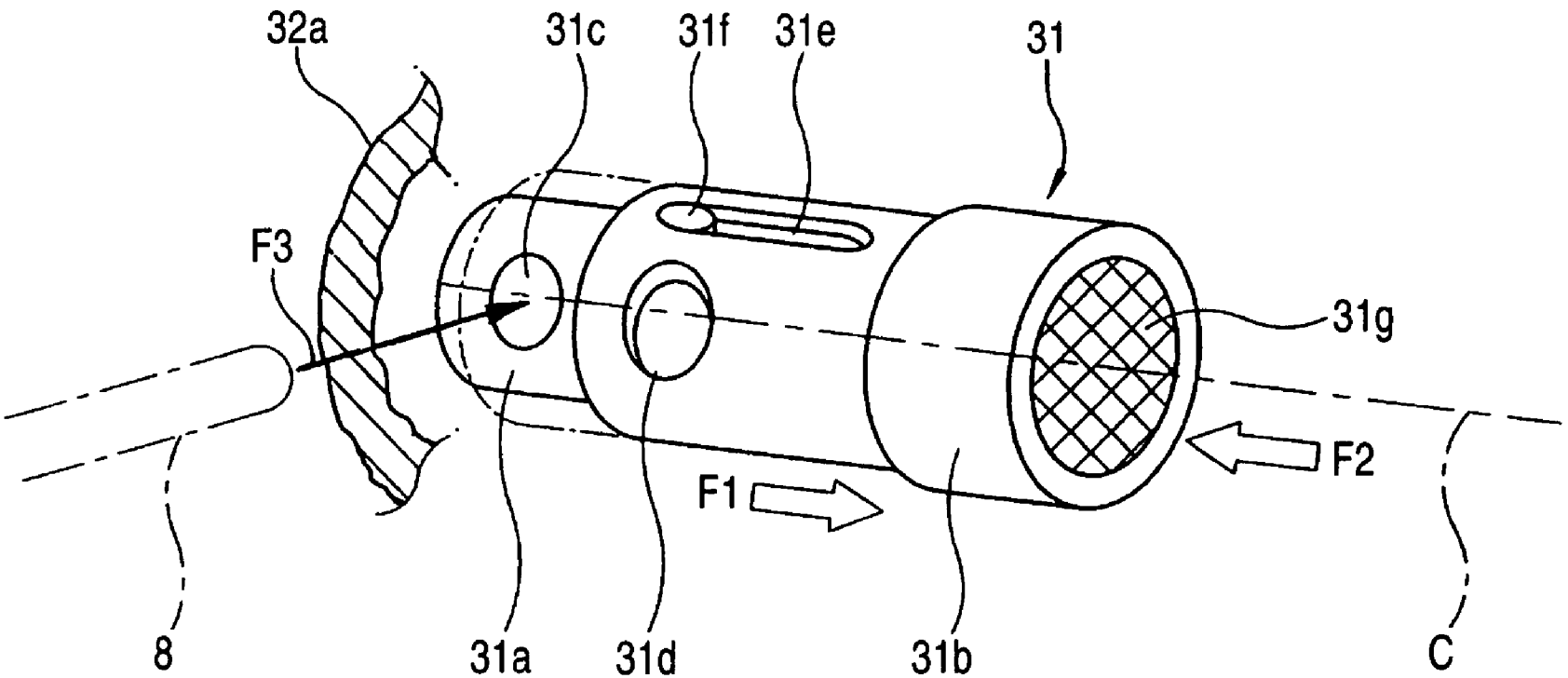
FIG. 4 is a perspective view enlarging a connection terminal of the speaker apparatus according to the first embodiment.

According to the connection terminal 31, as shown by FIG. 4, the connection terminals 31, 31 are push type including inner shafts 31*a* having holes 31*c* for inserting the connection cables 8, 8 and operating portions 31*b* which are slid by covering the inner shafts 31*a* and having outer holes 31*d* communicatable with the holes 31*c*.

According to the inner shafts 31*a* and the operating portions 31*b*, for example, the operating portion 31*b* is held movably along the axis line C by fitting a long hole 31*e* formed at the operating portion 31*b* and a guide projection 31*f* projected from the inner shaft 31*a* and is urged in a direction of a front end of the connection terminal (arrow mark F1 direction of FIG. 4) by a spring member, not illustrated, inwardly mounted to an inner side of the operating portions 31*b*.

The connection terminals 31, 31, differentiates the anode and the cathode, for example, front end faces 31*g* thereof are pasted with stickers having different colors. According to the configuration, not only parts of the connection terminals can be made common but also a failure in differentiating a display of a polarity can be avoided in integrating the connection terminal.

Therefore, by an operation of pushing the operating portion 31*b* (operation in a direction of an arrow mark F2), the operating portion 31*b* is moved relative to the inner shaft 31*a* and an opening of communicating the hole 31*c* and the outer holes 31*d* is formed. A front end portion of the connection cable 8 is inserted into the opening (arrow mark F3 direction), and the front end of the connection cable 8 is bit to be held by the hole 31*c* and the outer hole 31*d* by an urge force of the spring member by releasing the pushing operation. The cable can be connected by such an extremely simple operation.

Figure 6:
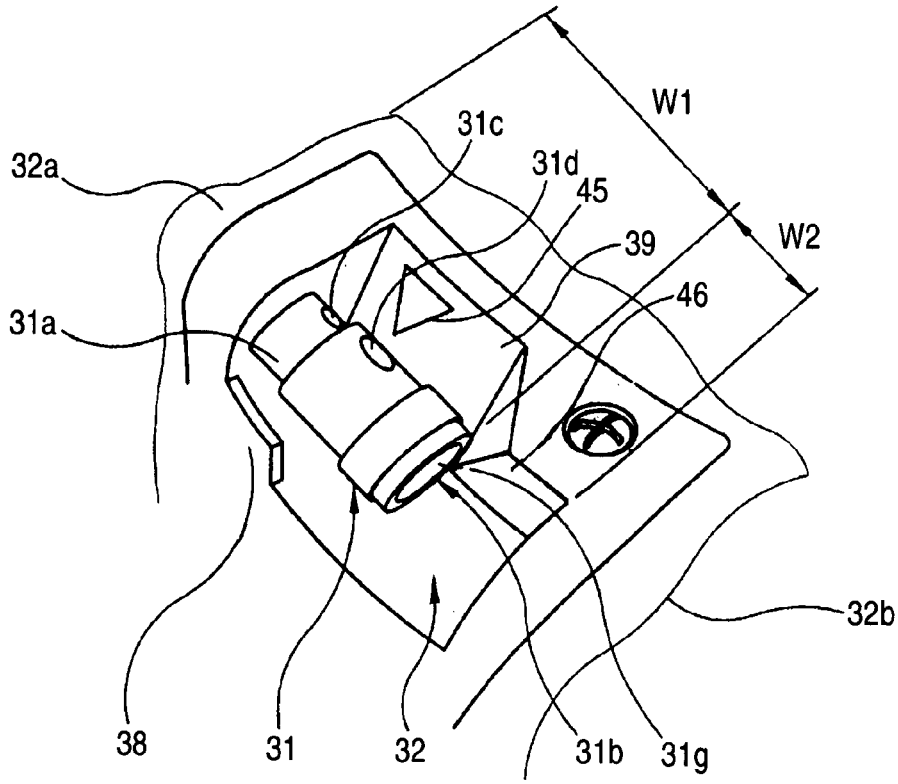
FIG. 6 is a perspective view enlarging a main point of the speaker apparatus according to the first embodiment.

According to the first embodiment, as shown by FIG. 5 and FIG. 6, outer peripheral sides of the speaker of the connection terminals 31, 31 are provided with locking walls 38 for preventing the front ends of the connection cables 8, 8 from being extruded to the outer peripheral sides of the speaker at positions opposed to the holes 31*c*. The locking wall 38 is constituted as an outer wall of the recess portion 32. According to the constitution, when the connection cable 8 is inserted, the front end can firmly be stopped at a predetermined position, a state of considerably extruding the front end of the connection cable 8 from the connection terminal 31 is avoided and, for example, the connection cable 8 can be prevented from being shortcircuited or the like.

According to the embodiment, there is provided a guide mark 71 for guiding a direction of inserting the connection cable 8. As the guide mark 71, for example, an arrow mark, a triangular mark or the like directed in a direction of the hole 31*c* can be used.

Further, the guide mark 71 is provided at the recess portion 32 or a vicinity thereof as a mark showing a direction directed to the hole 31*c*.

Further, according to the first embodiment, the guide mark 71 is formed at an inclined wall face 39 for guiding the front end of the connection cable 8 in inserting the connection cable 8. According to the constitution, when the connection cable 8 is inserted into the hole 31*c*, a direction of inserting the connection cable 8 or an operation of connecting the connection cable 8 to a position is guided by the guide mark 71, further, by enabling to utilize the inclined wall face 39 as a guide wall face such that the cord front end portion is slid along the inclined wall face 39, an operability in inserting the connection cable 8 can be promoted.

Further, the inclined wall face 39 is provided with an inclination of substantially 45 degrees as an angle of inclination β in an axial direction of the speaker relative to the speaker center line 37. Further, although the angle of inclination β can be set to an arbitrary angle, the angle of inclination can be set to, for example, an angle of inclination of 0 degree through 90 degrees. Further, it is preferable to form the direction of the hole 31*c* and the outer hole 31*d* such that the connection cables 31, 31 are directed to a skewed inner side along the back face of the speaker. By the constitution, the connection cables 31, 31 can be led out skewedly to the inner side of the back face of the speaker, and can be wired to be laid along the back face of the speaker and therefore, when there is a clearance to a degree of the thickness of the connection cables 31, 31, the speaker apparatus 30 can be installed to a space which is not provided with an allowance in a direction of the back face.

According to the first embodiment, the recess portion 32 includes faces of enabling to bring the thumb to sides of front end faces 31*g* of the connection terminals 31, 31 and providing outer wall faces 32*a* substantially in parallel with the front end faces 31*g* capable of bringing the forefinger thereto on an outer side of a connection base portion of the recess portion 32.

Therefore, a dimension W1 between the front end face 31*g* and the outer wall face 32*a* is set to, for example, about 40 mm. Further, an interval W2 between the front end face 31*g* and a wall portion 32*b* opposed to the front end face 31*g* is set to about 13 mm as a dimension of bringing the thumb of a comparatively big person thereto. Therefore, as shown by FIG. 7, a barrel portion of the thumb can press the connection terminal 31 while being brought into contact with the recess portion 32 or a frame portion therebelow.

Figure 7:
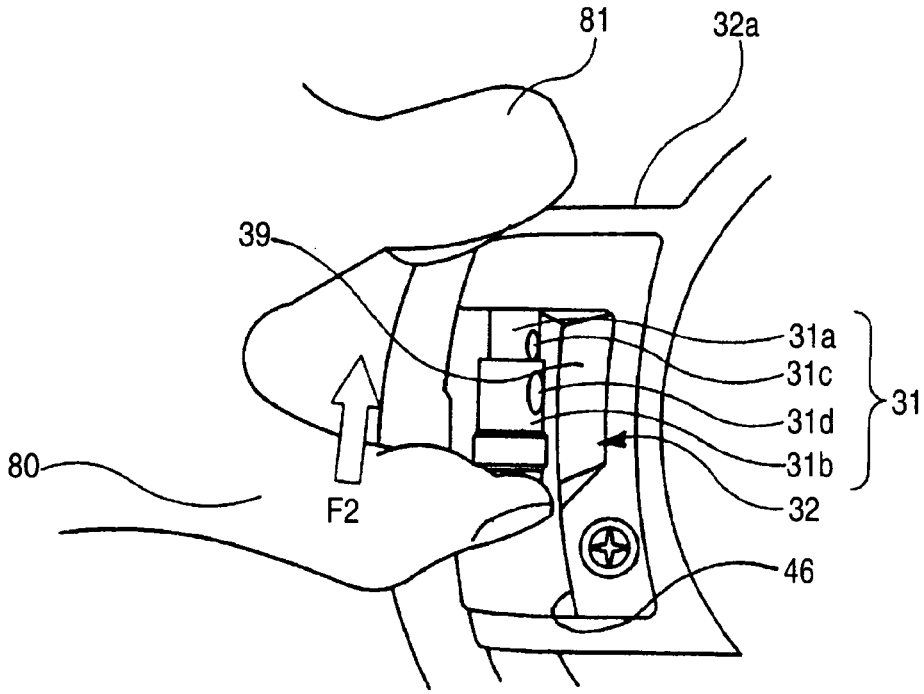
FIG. 7 is an outline plane view for explaining an operation of the connection terminal of the speaker apparatus according to the first embodiment.

According to the constitution, as shown by FIG. 7, in connecting the connection cable 8, by pushing the front end face 31*g* of the connection terminal 31 by the thumb 80 and touching to support a side face of the forefinger 81 to the outer peripheral wall 32*a*, the hole 31*c* and the outer hole 31*d* are communicated, and by inserting the front end of the connection cable 8 to the communicated opening and releasing the thumb 80 and the forefinger 81 from being pressed, the connection cable 8 can be bit by the opening. That is, a connection operability in connecting the connection cable 8 to the speaker apparatus 1 is extremely excellent.

Second Embodiment

Figure 8:
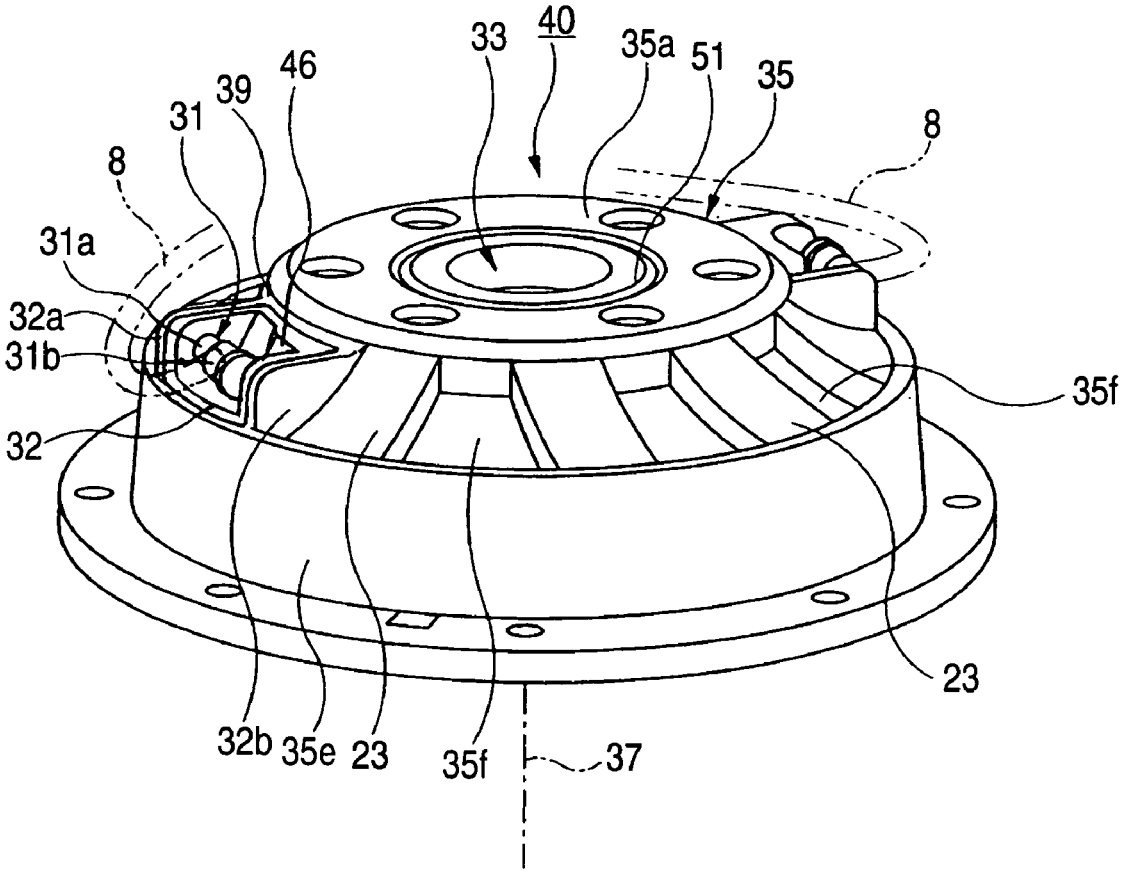
FIG. 8 is a perspective view of a speaker apparatus according to a second embodiment of the invention.

FIG. 8 is a perspective view of a speaker apparatus according to a second embodiment.

According to a speaker apparatus 40 of the second embodiment, a basic constitution thereof is the same as that of the speaker apparatus 30 of the first embodiment, the same constituent portions are attached with the same notations and an explanation thereof will be omitted.

The second embodiment shown in FIG. 8 differs from the first embodiment by connecting the connection cables 8, 8 from a side of a side face of the speaker. That is, according to the connection terminal 31, the hole 31*c* and the outer hole 31*d* are disposed on the side of the side face of the speaker and the connection cables 8, 8 are inserted from an outer side of the side of the side face of the speaker by the first embodiment which is not provided with the locking wall 38.

Therefore, the connection cables 8, 8 are not led out from the back face side of the speaker in the case of Example 1 but are led out from the side of the side face of the speaker as shown by FIG. 8. The case is suitable for a case in which a space in a thickness direction of the speaker is smaller than that in the case of the first embodiment and there is a comparatively large allowance in a space on the side of the side face of the speaker in a space of arranging the speaker apparatus 40.

The constitution of the connection terminal is not limited to the above-embodiments and can pertinently be changed in accordance with the scope of the invention. For example, instead of the connection terminal of the push type, a screw type one of attaching the connection cable by screwing a screw will do.

As has been described in details, the speaker apparatus 30 (40) is constituted such that the connection terminals 31, 31 for electrically connecting to outside of the speaker are provided, the connection terminals 31, 31 are arranged such that the axis lines C are in line with the tangential direction of the circumference of the speaker, and are not projected to the outer side in the diameter direction of the speaker from the speaker frame 35.

Thereby, even when the speaker apparatus 30 (40) is thinned, that is, even when the speaker frame 35 is constructed by the flat constitution, the connection terminals 31, 31 are not projected to the back face side of the speaker and thinned formation of the speaker apparatus 30 (40) is not hampered. Further, the axial lines C of the connection terminals 31, 31 are arranged in the circumferential direction (horizontal direction) of the speaker and therefore, it is easy to constitute a large size for making the diameter of the connection terminals 31, 31 thick and for prolonging the connection terminals 31, 31, as a result, the thick wire can be used for the connection cable, and it is easy to adopt the constitution which is easy to maintain the acoustic function.

According to the embodiments, even when the speaker is thinned, that is, even when the speaker frame is constituted to be flat, the connection terminal is not projected to the back face side of the speaker and thinned formation of the speaker is not hampered.

Further, since the axis line of the connection terminal is arranged in a circumferential direction (horizontal direction) of the speaker, it is easy to make the connection terminal large-sized making a diameter of the connection terminal bold and prolonging the connection terminal, as a result, a bold wire can be used for the connection cable and it is facilitated to adopt a constitution which is easy to maintain an acoustic function.

According to the embodiments, there can be adopted a constitution in which a cathode and an anode of the connection terminals are arranged substantially on opposed sides interposing a center of the speaker. According to the constitution, arrangement of the connection terminals is not concentrated to one portion but can be dispersed to two portions, and a comparatively large one of the connection terminal can be provided.

According to the embodiments, there is constructed a constitution in which the connection terminal is provided at a recess portion of the speaker frame so as not to be projected from the speaker frame on a back face side of the speaker.

According to the embodiments, the connection terminal may be formed such that a connection cable connected thereto is directed to a skewed-inner side along a back face of the speaker. Further, it is preferable that a wall face inclined by substantially 45 degrees for guiding a front end of the connection cable in inserting the connection cable. According to the constitution, the connection cable can be led out skewedly to an inner side of the back face of the speaker, and can be wired to be laid along the back face of the speaker and therefore, when there is a clearance to a degree of a thickness of the connection cable, the speaker apparatus can be installed in a space which is not provided with an allowance in the direction of the back face.

According to the embodiments, the connection terminal can adopt a push type constitution including an inner shaft having a hole for inserting to connect the connection cable and an operating portion sliding to cover the inner shaft and having an outer hole communicatable with the hole. Further, it is preferable that directions of the hole and the outer hole are formed such that the connection cable is directed to the skewed inner side along the back face of the speaker. According to the constitution, the cable can be connected by a simple operation of inserting the connection cable into the hole by an operation of pushing the operating portion.

According to the embodiments, there can be adopted a constitution in which an outer peripheral side of the speaker of the connection terminal is provided with a locking wall for preventing the front end of the connection cable connected to the connection terminal from being extruded to the outer peripheral side of the speaker. According to such a constitution, when the connection cable is inserted thereinto, the front end is firmly stopped at a predetermined position and therefore, firm connection is guaranteed, further, the front end of the connection cable can be prevented from being extruded from the connection terminal, and the connection cable can be prevented from being shortcircuited. Further, it is possible that the locking wall is provided to constitute an outer wall of the recess portion.

According to the embodiments, a guide mark for guiding a direction of inserting the connection cable is provided. Further, according to the embodiments, it can be constituted that the guide mark is an arrow mark directed in the direction of the hole. There can be constructed a constitution in which the guide mark is constituted by substantially an arrow mark directed to the hole and is provided at the recess portion or a vicinity thereof.

According to the constitution, a direction of inserting the connection cable and the operation of connecting a position thereof are guided by the guide mark and handling of the operation is extremely facilitated.

Further, according to the embodiments, a portion formed with the guide mark can be constituted at the inclined wall face for guiding the front end in inserting the connection cable. According to the constitution, when the connection cable is inserted into the hole, the wall face can be utilized as a guide wall such that a cord front end portion thereof is slid along the inclined wall face, and an operation of attaching the connection cable can be promoted. Further, the inclined wall face functions as the guide wall face in a direction of a wire of the connection cable after connection.

According to the embodiments, the recess portion includes a space for enabling to bring the thumb to a side of a front end face of the connection terminal, and an outer side of a connection base portion of the recess portion is provided with an outer wall face to which the forefinger can be touched. According to the constitution, there can be carried out an operation of pushing the front end of the connection terminal by pinching the front end and the outer wall face of the connection terminal by the fingers, for example, when the connection terminal is constructed by a constitution of the above-described push type, an operability of connecting the connection cable can be improved.

According to the embodiments, the speaker apparatus can be applied to a thin type speaker arranged with the magnetic circuit and the connection terminal to a substantially align in a speaker plane direction. According to the constitution, by constructing the connection terminal by a constitution of being extended in the speaker plane direction, thinned formation of the speaker can further be promoted.

The embodiments are applicable to a speaker apparatus including a vibrating plate and a drive member arranged coaxially with each other along a direction of driving the magnetic circuit. Outer peripheral portions of the vibrating plate and the drive member are fixed to vibrating plate supporting portions on the frame, inner peripheral portions of the vibrating plate and the drive member are bonded to be fixed to a voice coil bobbin, a space surrounded by the vibrating plate and the drive member and the frame are hermetically closed, and a vibrating system is supported by the voice coil bobbin by a spring performance of gas at inside of the space.

What is claimed is:

1. A speaker apparatus comprising:

a vibrating plate;

a magnetic circuit for vibrating the vibrating plate in a direction toward an axial center line of the speaker apparatus;

a speaker frame comprising a bottom plate portion for holding the magnetic circuit;

at least two connection terminals, supported by the speaker frame, for electrically connecting to an outside of a speaker; and at least two connection cables configured to transmit an electrical signal to the speaker, wherein:

an axis line of each of the connection terminals is arranged along a tangential line direction of a circumference of the speaker in a recess portion disposed between the bottom plate portion and a circumference of the speaker;

each connection cable is connected to a corresponding one of the connection terminals;

each of the connection cables is pulled out from the corresponding connection terminal in a direction from the circumference toward the axial center line; and the direction is inclined substantially 45 degrees relative to the axial center line.

2. The speaker apparatus according to claim 1, wherein the at least two connection terminals comprise a positive terminal and a negative terminal which are arranged substantially on opposite sides with respect to the axial center line.

3. The speaker apparatus according to claim 1, wherein the at least two connection cables are arranged on a portion near the connection terminals so as not to be projected from the speaker frame on a back face side of the speaker.

4. The speaker apparatus according to claim 1, further comprising:

a wall face inclined by substantially 45 degrees with respect to the bottom plate portion for guiding a front end of each of the connection cables in inserting the connection cables, the wall face being disposed at the recess portion.

5. The speaker apparatus according to claim 1, wherein each of the connection terminals comprise:

an inner shaft comprising a hole for inserting to connect the respective connection cable; and an operating portion sliding to cover the inner shaft and having an outer hole communicable with the hole of the inner shaft.

6. The speaker apparatus according to claim 3, wherein each of the connection terminals comprise a locking wall on an outer peripheral side thereof, and where the locking wall can prevent a front end of the respective connection cable connected to the connection terminal from being extruded to an outer peripheral side of the speaker.

7. The speaker apparatus according to claim 6, the locking wall is an outer wall of the recess portion.

8. The speaker apparatus according to claim 1, further comprising;

a guide mark for guiding a direction of inserting the connection cable.

9. The speaker apparatus according to claim 8, wherein the guide mark is an arrow mark directed in the same direction of the directions of the hole and the outer hole.

10. The speaker apparatus according to claim 3, further comprising;

a guide mark for guiding a direction of inserting one of the connection cables, wherein the guide mark is a substantially arrow mark directed to the hole, and wherein the guide mark is provided at the recess portion or a vicinity thereof.

11. The speaker apparatus according to claim 4, further comprising;

a guide mark for guiding a direction of inserting one of the connection cables, wherein the guide mark is provided at the inclined wall face.

12. The speaker apparatus according to claim 3, wherein the recess portion comprises; a connection base portion and a space for enabling to bring a thumb to a side of a front end face of the respective connection terminal, the connection base portion comprising an outer wall face to which a forefinger can be touched on an outer side thereof.

13. The speaker apparatus according to claim 1, wherein the speaker apparatus is a thinned type speaker arranged with the magnetic circuit and the connection terminal to substantially align in a speaker plane direction.

14. The speaker apparatus according to claim 1, further comprising;

a drive member arranged coaxially with the vibrating plate along the axial center line in a direction of driving the magnetic circuit;

said speaker frame comprising a vibrating plate supporting portion; and a voice coil bobbin, wherein the vibrating plate and the drive member are fixed to the vibrating plate supporting portion on outer peripheral portions thereof, wherein an inner peripheral portion of the vibrating plate is fixed to the drive member, and an inner peripheral portion of the drive member is fixed to the voice coil bobbin, wherein a space surrounded by the vibrating plate and the drive member and the speaker frame is hermetically closed, and wherein a vibrating system is supported by the voice coil bobbin by a spring performance of gas inside of the space.

15. The speaker apparatus according to claim 4, wherein the connection cable inserted in the hole is arranged along the wall face and a back face of the speaker.

16. The speaker apparatus according to claim 1, wherein each of the connection cables, pulled out from the corresponding one of the connection terminals, comprises a first portion which extends toward a center of the bottom plate portion and a second portion which turns near a center toward an outside of the speaker.

17. The speaker apparatus according to claim 5, wherein the hole and the outer hole are opened to a substantial 45 degree angular direction with respect to the bottom plate portion in a cross-section surface with respect to the center line of the speaker.

* * * * *